US006301756B1

(12) United States Patent
Howard

(10) Patent No.: US 6,301,756 B1
(45) Date of Patent: Oct. 16, 2001

(54) CLIP

(76) Inventor: Fred Howard, 146 W. 57th St., New York, NY (US) 10019

( * ) Notice: Subject to any disclaimer, the term of this patent is extended or adjusted under 35 U.S.C. 154(b) by 0 days.

(21) Appl. No.: 09/520,090

(22) Filed: Mar. 7, 2000

Related U.S. Application Data

(60) Provisional application No. 60/124,551, filed on Mar. 16, 1999.

(51) Int. Cl.[7] ..... A44B 21/00

(52) U.S. Cl. ..... 24/552; 24/553; 24/327; 24/545

(58) Field of Search ..... 24/3.2, 3.7, 3.11, 24/3.12, 327, 329, 331, 499, 552, 553, 564, 559, 557, 551; 223/96; 40/332, 658, 666

(56) References Cited

U.S. PATENT DOCUMENTS

| | | | | |
|---|---|---|---|---|
| 689,811 | * | 12/1901 | Brownley . | |
| 1,393,577 | * | 10/1921 | Ryason . | |
| 2,585,089 | * | 2/1952 | Caldwell et al. | 24/261 |
| 2,601,026 | * | 6/1952 | Jones | 40/23 |
| 2,729,868 | * | 1/1956 | Manning | 24/255 |
| 2,931,086 | * | 4/1960 | Rose | 24/137 |
| 3,482,293 | * | 12/1969 | Takahashi et al. | 24/255 |
| 4,011,673 | * | 3/1977 | Levine | 40/23 |
| 4,097,971 | * | 7/1978 | Morris | 40/1.5 |
| 4,261,121 | * | 4/1981 | Coon | 40/322 |
| 4,277,864 | * | 7/1981 | Orson, Sr. | 24/327 |
| 4,536,924 | * | 8/1985 | Willoughby | 24/487 |
| 4,630,385 | * | 12/1986 | Swim | 40/340 |
| 4,763,390 | * | 8/1988 | Rooz | 24/557 X |
| 5,159,731 | * | 11/1992 | Dereadt | 24/552 |
| 5,440,791 | * | 8/1995 | Guio | 24/545 |
| 5,640,742 | * | 6/1997 | White et al. | 24/3.12 |
| 5,913,478 | * | 6/1999 | Ochsman | 24/7 |
| 5,924,176 | * | 7/1999 | Lee | 24/553 |
| 6,003,211 | * | 12/1999 | Chen | 24/545 |

* cited by examiner

*Primary Examiner*—Robert J. Sandy
(74) *Attorney, Agent, or Firm*—Cohen, Pontani, Lieberman & Pavane

(57) ABSTRACT

A clip design for securing an object to an article of clothing on a wearer. The clip contains first and second display surfaces for conveying a message, slogan or other device to a wearer and to others in proximity to the wearer when the clip is in use. The display surfaces are oriented in a direction opposite from each other and positioned such that a message contained on the surfaces are oriented in a direction to be visually perceivable by the wearer.

7 Claims, 3 Drawing Sheets

CLIP

RELATED APPLICATIONS

This application claims priority from U.S. Provisional Patent Application Ser. No. 60/124,551 which was filed on Mar. 16, 1999.

BACKGROUND OF THE INVENTION

1. Field of the Invention

The present invention relates to a clip for use in fastening a napkin or other object to an article of clothing on a wearer. Particularly, the present invention pertains to a napkin clip which includes flat surface areas for displaying words or symbols for use in advertising.

2. Description of the Related Art

Business providers oftentimes provide premiums, typically consisting of small, inexpensive souvenirs such as pens, buttons, pads, etc., which usually have a business provider's name, address and/or telephone number imprinted thereon. Such premiums are typically distributed at trade shows, business conventions, as well as in more common environments such as hotels, restaurants, etc. Premiums typically serve a dual purpose, namely to provide practical utility, such as in the case of a pen, and to convey a business name to a user or potential customer, e.g., by depicting a business name on a pen. It is also desirable for premiums to be inexpensive and of relatively small size so that they can be produced in bulk quantities and given away more readily.

An example of a practical premium is a clip for use, for example, as a paper clip for releasably securing papers together or in a garment clip for use in releasably securing a napkin to an article of clothing, the latter use being particularly beneficial for restaurant patrons. Existing clips known by applicant are considered unsuitable for premium use because such clips posses relatively small dimensions including thin frame diameters which make it difficult to display a company name, trademark or symbol in a manner that can be easily seen by the wearer or by others proximate to the wearer. Accordingly, there exists a need for a napkin clip design which provides for releasably securing a napkin to a user while providing an advertising surface for displaying visible indicia such as text or symbols.

SUMMARY OF THE INVENTION

A clip is provided for use as an advertising medium of business owners, and in particular, restaurant owners and credit card providers for use in restaurants and other establishments where food is served. The inventive clip serves its intended purpose, namely to releasably secure a napkin to a wearer's clothing to protect the clothing from, for example, splattered food. The clip also serves an additional benefit of providing one or more surfaces for displaying, in a manner visible by the wearer and/or by others proximate the wearer, an advertising slogan, symbol or trademark. The symbols or trademarks are preferably those of the restaurant in which the clip is used and may also be of the clip provider, e.g. a credit card services provider who supplies clips to a restaurant for use by the restaurant's patrons.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
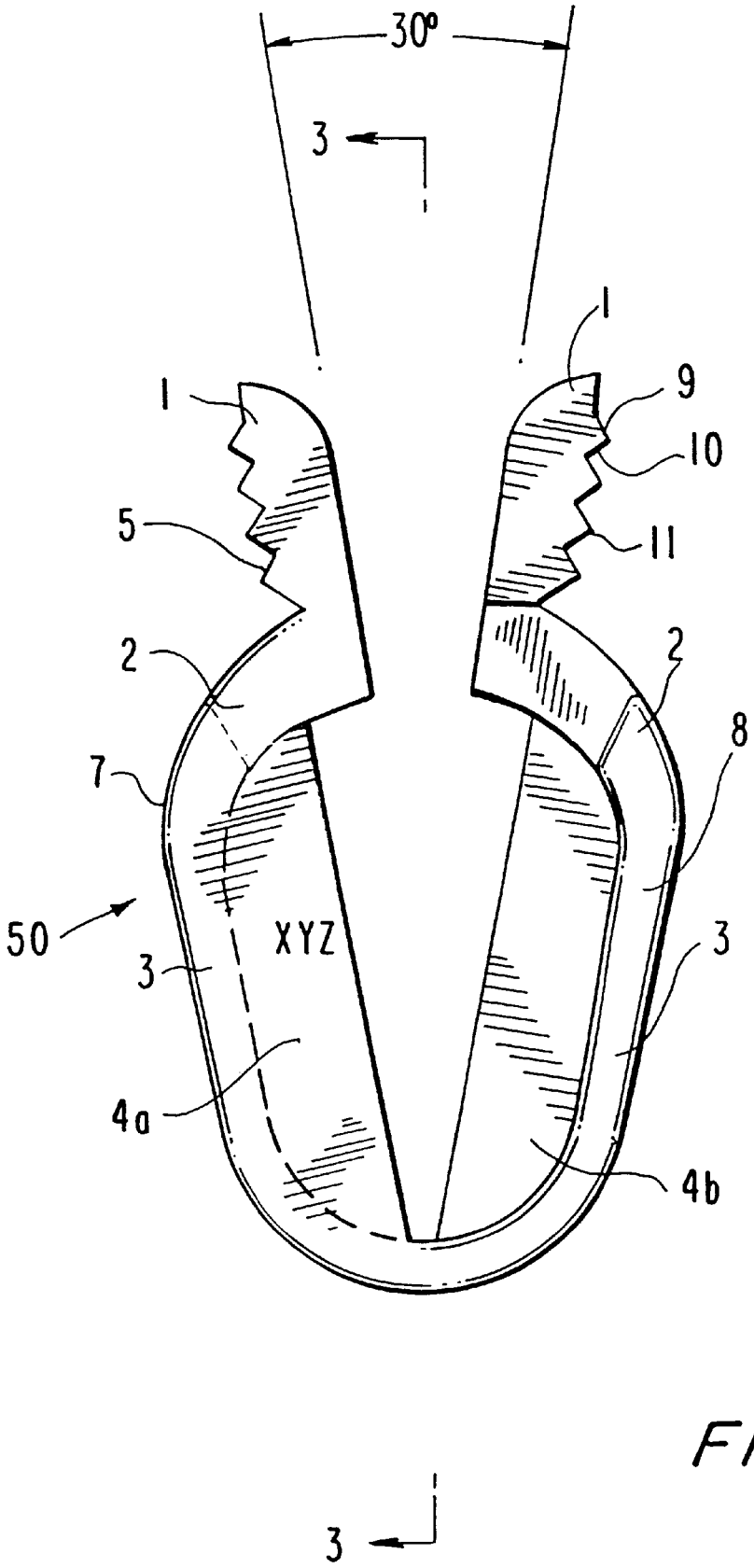
FIG. 1 is a front view of a clip in accordance with the present invention, depicted in a non-operative, relaxed state.

With reference to FIG. 1, the clip 50 according to the present invention is shown in a relaxed, unengaged state. As shown, clip 10 has two opposing arms 7 and 8, having a desired thickness with each having an engaging end 1 and a curved section 3 with a recessed section 2. Clip 10 is preferably molded from an elastic material having a memory or "spring force", such as, for example, plastic. Each arm has a front surface with a panel 4*a*, 4*b* defining a plane, and a rear surface with a recess 6 defined by the recessed section 2. Arms 7 and 8 are substantially identical and are integrally connected to each other at a bight 20. When the clip 10 is in a non-operative and relaxed state, it forms a general V-shape as shown, with the two arms slightly biased away from each other due to the memory in the clip material. Preferably the memory in the material is such that the arms 7 and 8 are angularly separated by approximately 30°.

Each engaging end 1 has two opposite faces, one containing a securing region preferably configured as a plurality of teeth 5 for securing a napkin or other object to a wearer's clothing, as explained more fully below, the other having a smooth, flat surface. The teeth are preferably integrally formed with the arms 7 and 8 and have a relatively dull engaging edge to avoid damaging a user's clothing when the clip is used in its intended manner, i.e. to secure an object such as a napkin to a user's tie, shirt, etc.

Section 1 forms engaging ends and has two opposite faces, one containing a securing region preferably configured as a plurality of teeth 5 for securing a napkin or other object to a wearer's clothing, as explained more fully below, and the other faces having a smooth, flat surface. The teeth are preferably integrally formed with the arms 7 and 8 and have a relatively dull engaging edge to avoid damaging a user's clothing when the clip is used in its intended manner, i.e. to secure an object such as a napkin to a user's tie, shirt, etc.

Each arm has a panel 4*a*, 4*b* connected across each curved section 3. In particular, panel 4*a* is attached to or formed integrally with arm 7 and positioned so that an upper surface of the panel 4*a* is coplanar with the upper face of arm 7, and panel 4*b* is connected to arm 8 so that an upper surface is coplanar with the lower surface of arm 8. Each curved section 3 has a semi-oval shape and the corresponding panels 4*a* and 4*b* have a semi-oval profile which spans the curved section in a chord-like fashion. Although the preferred embodiment employs two panels 4*a* and 4*b*, a panel can be provided on only one arm without departing from the scope of the present invention.

In accordance with the present invention, panels 4*a* and 4*b* provide suitable areas for placing visible indicia such as advertising words and/or symbols for display to a wearer of the clip 10 or to people in proximity to the wearer who are within sight of the clip. As shown in FIG. 1, surface 4*a* is depicted containing a message "XYZ", referred to herein as a "primary" message, which may correspond to a name, symbol or trademark of the clip manufacturer or clip sponsor. The clip sponsor may be, for example, a credit card company such as AMERICAN EXPRESS® and the primary message may be carried on surface 4*a* in any known manner such as by adhesive, glue, tape, etc. The primary message may be attached or affixed to surface 4*a* by printing the message, for example, on decals and attaching the decals in a known manner. Preferably, the primary message is molded into surface 4*a* during the manufacture of clips 10, as such a technique will avoid the need to separately attach each decal to the surfaces 4*a*.

The remaining surface 4*b* may serve as a platform for a secondary message conveying or displaying a message or symbol corresponding to an environment in which the clip 10 is used. For example, if a batch of clips are intended for use in a particular restaurant which is sponsored by a credit card company, the batch of the clips can be produced in bulk quantities, with each clip containing an identical primary message, e.g. the name of the sponsor. Thereafter, a group of clips 10 from the produced quantity can be supplied to the particular restaurant, along with labels or decals bearing the particular restaurant name. The decals can then be attached to surface 4*b*, whereupon, each clip will display the primary message, e.g., the credit card company name, and a secondary message, e.g., the restaurant name. The clips can then be presented to restaurant patrons as premiums or as a courtesy for patron use at the restaurant.

Figure 3:
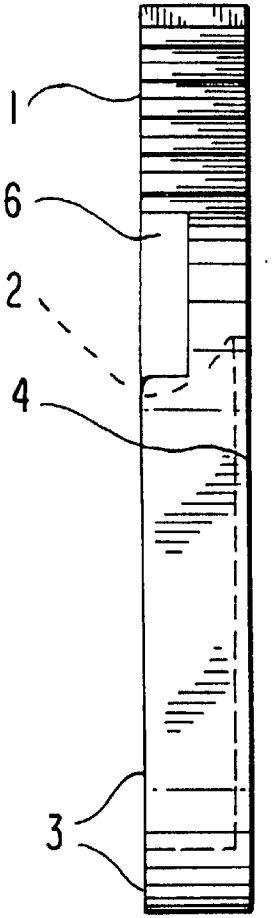
FIG. 3 is a cross-section view of the clip along section line 3—3 as shown in FIG. 1.
Figure 2:
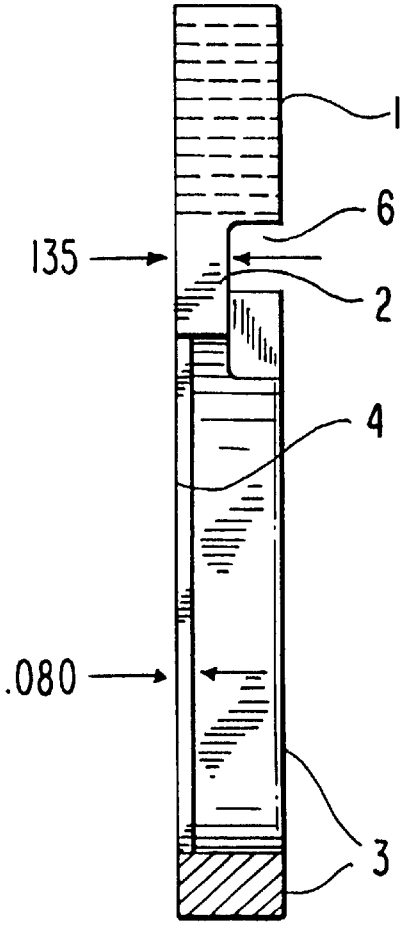
FIG. 2 is a right-side view of the clip as shown in FIG. 1.

With reference to FIGS. 2 and 3, the presently preferred dimensions of the clip 10 are shown with engaging ends 1 and curved sections 3 having a width of 0.14 inches and a thickness of 0.29 inches. Recessed section 2 is shown having a thickness of 0.135 inch and panels 4*a* and 4*b* are shown having a thickness of 0.08 inch. The clip has an overall length of 2.3 inches.

Figure 4:
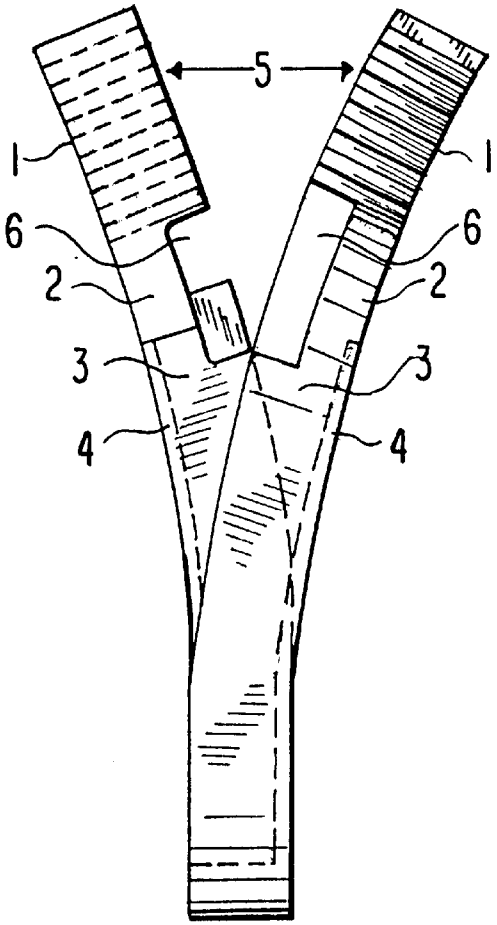
FIG. 4 is a right-side view of the clip shown in a transitional state of assembly.
Figure 6:
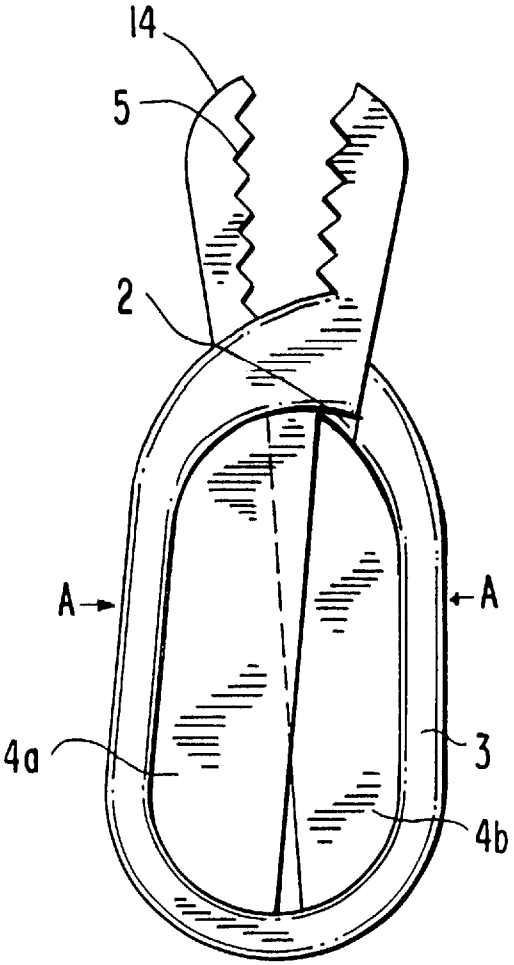
FIG. 6 shows the clip in its opened state.
Figure 5:
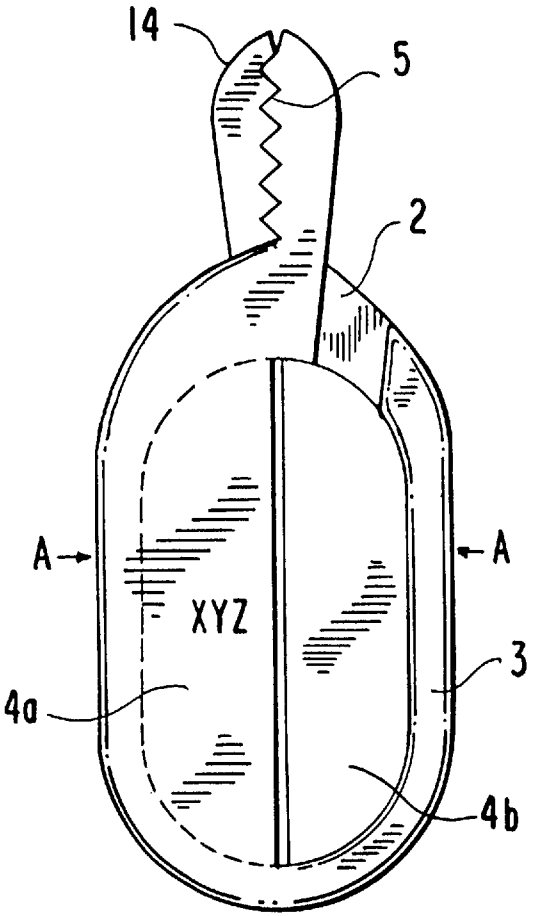
FIG. 5 depicts the clip in its closed operative state.

The initial or relaxed state of clip 10 as shown in FIG. 1 is changed to an operable state as shown in FIG. 5 by partially twisting the arms 7 and 8 in the manner shown in FIG. 4 and crossing the arms over each other so that each recessed portion 2 lies in the recess 6 of the other arm, and the teeth portions 5 on arms 7 and 8 are brought into an engaging position as a result of the elasticity of the bight 20. Thus, the teeth of arm 7 interleave with and press against the teeth of arm 8. Once in this position, the clip is engaged by applying a force to counteract the spring force. This is accomplished by pressing on arms 7 and 8 in a direction indicated by arrows "A" in FIGS. 5 and 6 whereupon teeth portions 5 will disengage from each other to allow the clip 10 to be attached to a wearer's shirt. In particular, by engaging the clip 10 in this manner, a napkin can be clamped to a wearer's shirt, for example, by opening the clip, placing the teeth 5 about a portion of the wearer's shirt and a portion of a napkin, and releasing the clip, whereupon the teeth 5 will engage and clamp the napkin to the wearer's shirt. Once so-positioned, the clip 10 is oriented in such a way that either of surfaces 4*a* and 4*b* will be facing upward in a direction visible to the wearer and to those in proximity of the wearer. Thus, the message contained on the upwardly facing surface 4*a* or 4*b* will, likewise, be visible, for creating an advertising medium for the clip sponsor and/or restaurant owner.

With reference now to FIGS. 4 and 5, the initial or relaxed state of clip 10 as shown in FIG. 1 is changed to an operable state as shown in FIG. 5 by partially twisting the arms 7 and 8 in the manner shown in FIG. 4 so that the teeth portions 5 on arms 7 and 8 are brought into an engaging position as a result of the spring force of the material from which the clip 10 is constructed. Thus, the teeth of arm 7 interleave with and press against the teeth of arm 8. Once in this position, the clip is engaged by applying a force to counteract the spring force. This is accomplished by pressing on arms 7 and 8 in a direction indicated by arrows "A" in FIGS. 5 and 6 whereupon teeth portions 5 will disengage from each other to allow the clip 10 to be attached to a wearer's shirt. In particular, by engaging the clip 10 in this manner, a napkin can be clamped to a wearer's shirt, for example, by opening the clip, placing the teeth 5 about a portion of the wearer's shirt and a portion of a napkin, and releasing the clip, whereupon the teeth 5 will engage and clamp the napkin to the wearer's shirt. Once so positioned, the clip 10 is oriented in such a way that either of surfaces 4*a* and 4*b* will be facing upward in a direction visible to the wearer and to those in proximity of the wearer. Thus, the message contained on the upwardly facing surface 4*a* or 4*b* will, likewise, be visible, for creating an advertising medium for the clip sponsor and/or restaurant owner.

While there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, although the inventive clip is described herein for the purpose of securing a napkin to a shirt, tie or other article of clothing of a wearer, it is also useable for securing other objects to a wearer such as, for example, a name tag, badge, etc. It is expressly intended, therefore, that all combinations of those elements and/or method steps which perform substantially the same function in substantially the same way to achieve the same results are within the scope of the invention.

What is claimed is:

1. A clip for releasably securing an object to an article of clothing, said clip comprising:

a pair of arms integrally connected at an elastically deformable bight, each arm having a curved portion extending from the bight, and an engaging end with a securing surface remote from the bight, said arms crossing over each other adjacent to said engaging ends so that said securing surfaces are resiliently loaded against each other by said elastically deformable bight, whereby said securing surfaces can be moved apart by pressing said curved sections together, and at least one panel secured to a respective at least one of said arms, said panel spanning the curved section in chord-like fashion.

2. A clip as in claim 1, comprising a pair of said panels, each said panel being secured to a respective one of said arms.

3. A clip as in claim 1, wherein said at least one panel is formed integrally with said arms.

4. A clip as in claim 1, wherein each of said arms has a semi-oval shape, said at least one panel having a semi-oval profile which fits flushly within said semi-oval shape.

5. A clip as in claim 1, wherein each said curved section has a recessed section formed with a recess where said arms cross over each other, each said recessed section being received in a recess formed on the other arm.

6. A clip as in claim 1 further comprising visible indicia on said at least one panel.

7. A clip as in claim 1 wherein said securing surfaces are formed with teeth.

* * * * *